US006036178A

United States Patent [19]

Nilsson

[11] Patent Number: 6,036,178

[45] **Date of Patent: *Mar. 14, 2000**

[54] DEVICE FOR MIXING AIR AND WATER IN A WATER PURIFIER

[75] Inventor: Bror Nilsson, Svedala, Sweden

[73] Assignee: Libradon AB, Svedala, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 08/973,980

[22] PCT Filed: Jun. 24, 1996

[86] PCT No.: PCT/SE96/00817

§ 371 Date: Dec. 15, 1997

§ 102(e) Date: Dec. 15, 1997

[87] PCT Pub. No.: WO97/00831

PCT Pub. Date: Jan. 9, 1997

[30] Foreign Application Priority Data

Jun. 22, 1995 [SE] Sweden ..... 9502269

[51] Int. Cl.[7] ..... B01F 3/04

[52] U.S. Cl. ..... 261/76; 261/78.2

[58] Field of Search ..... 261/76, 78.2, DIG. 75

[56] References Cited

U.S. PATENT DOCUMENTS

| | | | |
|---|---|---|---|
| 895,790 | 8/1908 | Richards | 261/76 |
| 1,821,914 | 9/1931 | Wagener | 261/DIG. 75 |
| 1,839,952 | 1/1932 | Daily | 261/78.2 |
| 2,183,561 | 12/1939 | Hamblin | 261/76 |
| 2,633,344 | 3/1953 | Rekk | 261/76 |
| 3,761,066 | 9/1973 | Wheeler | 261/78.2 |
| 4,267,131 | 5/1981 | Prudhon et al. | 261/78.2 |
| 4,389,312 | 6/1983 | Beard . | |
| 4,564,480 | 1/1986 | Kamelmacher | 261/DIG. 75 |
| 4,861,165 | 8/1989 | Fredriksson et al. | 261/76 |
| 4,911,836 | 3/1990 | Haggerty | 261/DIG. 75 |
| 4,931,225 | 6/1990 | Cheng | 261/76 |
| 5,023,021 | 6/1991 | Conrad | 261/76 |
| 5,437,784 | 8/1995 | Meinecke et al. | 261/76 |
| 5,525,242 | 6/1996 | Kerecz | 261/DIG. 75 |

FOREIGN PATENT DOCUMENTS

| | | | |
|---|---|---|---|
| 741413 | 5/1970 | France | 261/78.2 |
| 43 14507 C1 | 6/1994 | Germany . | |
| 1711926 | 11/1978 | Hungary . | |
| 203682 | 8/1992 | Hungary . | |
| 214806 | 5/1998 | Hungary . | |
| 53-41858 | 4/1978 | Japan | 261/78.2 |
| 56-15892 | 2/1981 | Japan . | |
| 8900169 | 7/1990 | Sweden . | |
| 9303412 | 4/1995 | Sweden . | |
| 9402780 | 7/1995 | Sweden . | |
| 9403643 | 12/1995 | Sweden . | |
| 9502269 | 4/1996 | Sweden . | |
| 652046 | 10/1985 | Switzerland . | |
| 1456205 | 2/1989 | U.S.S.R. . | |
| 2 096 911 | 10/1982 | United Kingdom | 261/78.2 |

OTHER PUBLICATIONS

Sheet Listing English translation of Claim 1 of HU 171 926 and English translation of Title and Abstract of HU 203 682.

*Primary Examiner*—C. Scott Bushey
*Attorney, Agent, or Firm*—Smith, Gambrell & Russell, LLP

[57] ABSTRACT

A device for mixing air and water in a water purifier comprises a water inlet pipe (3), which is connected to a water source and extends into a water purifier tank (2), and an air inlet pipe (6) extending coaxially inside the water pipe. One end of the air pipe is positioned outside the tank and the other end is positioned inside the water pipe to form an annular gap (8) between the end (7) of the air pipe and the inner wall of the water pipe. The water pipe has a mixing portion (9, 13) extending from the annular gap (8) to the mouth of the water pipe in the tank. In the mixing portion there is at least one ring (10–12) arranged on the inside of the water pipe and being hit by an annular water jet formed as the water passes through the gap (8), thereby forcing the water to mix with the air.

7 Claims, 1 Drawing Sheet

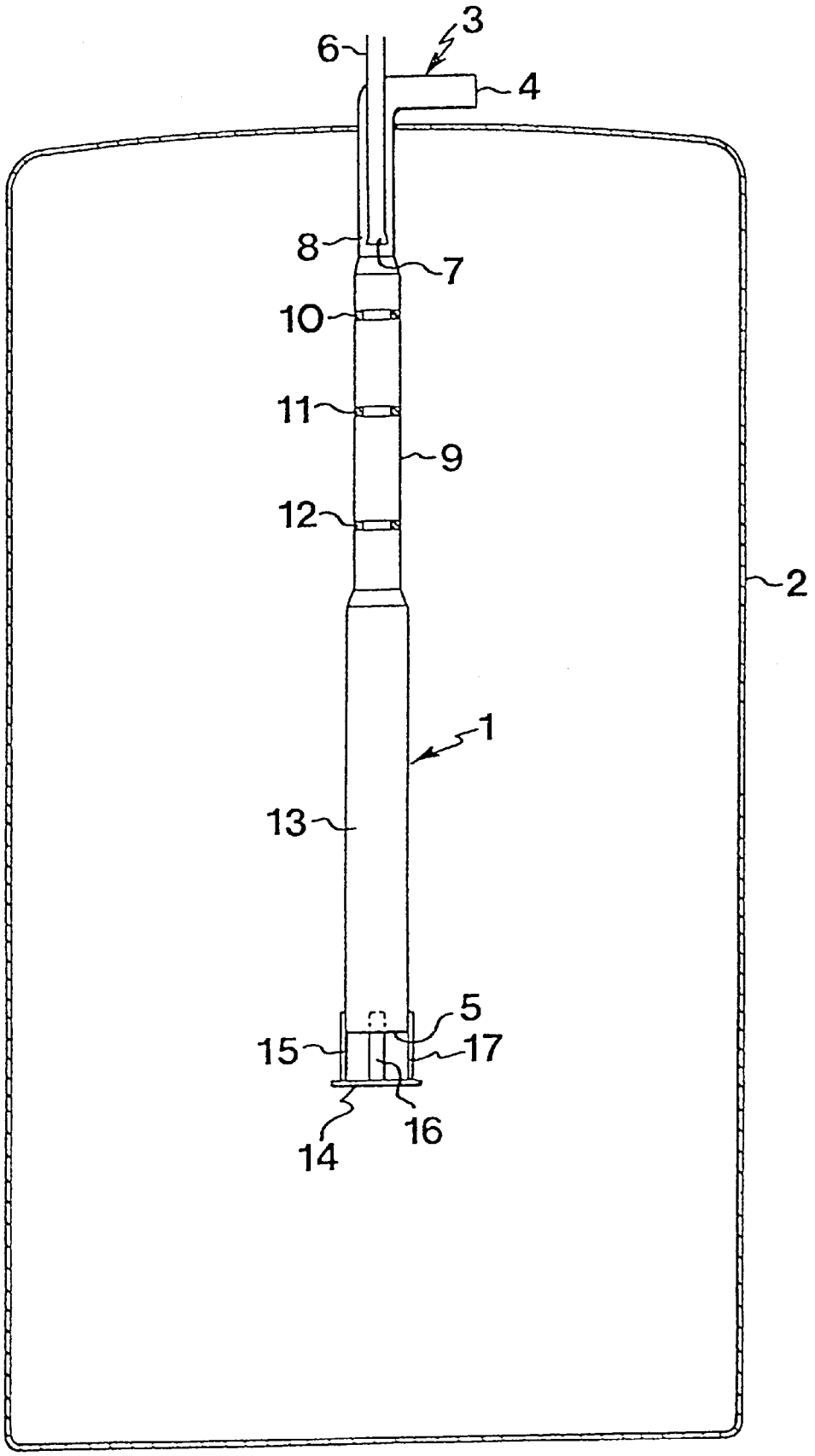
3
6
4
8
7
10
11
9
12
2
1
13
5
15
17
16
14

DEVICE FOR MIXING AIR AND WATER IN A WATER PURIFIER

BACKGROUND OF THE INVENTION

1. Field of the Invention

The present invention relates to a device for mixing air and water in a water purifier, said device comprising a water inlet pipe, which is connected to a water source and which extends into a water purifier tank, and an air inlet pipe extending coaxially inside the water pipe, one end of the air pipe being positioned outside the tank and the other end being positioned inside the water pipe to form an annular gap between the end of the air pipe and the inner wall of the water pipe, and the water pipe having a mixing portion which extends from the annular gap to the water pipe mouth in the tank.

2. Description of the Related Art

Aerating drinking-water is a prior-art method of reducing the amount of impurities in the water. Such water purifiers are disclosed in e.g. Swedish Patent 8900169-7 and Swedish Patent Applications 9303412-2, 9402780-2 and 9403643-1. In all the constructions shown in these publications, use is made of the ejector principle for admixing air to drinking-water which is pumped into a tank from a drinking-water source. The amount of air, actually the oxygen in the air, which is blended with the water affects the purifying process. The more oxygen blended with the water, the better the purification.

A technique of increasing the oxygen content in the water is to let the water-air mixture from the ejector flow out in the tank below the water surface in the tank. This is disclosed in SE-9403643-1. A stirring effect is accomplished in the tank, which is advantageous for the blending of oxygen with the water. In tests, it has been found that also an increased intake of air through the air inlet pipe is achieved by the flowing-out taking place below the water surface.

In spite of the increased air intake and the use of said stirring effect, the purification of the water will deteriorate owing to the fact that air and water mix worse as the flow rate increases.

OBJECTS AND SUMMARY OF THE INVENTION

The object of the invention is to solve this problem and provide a mixing device which supplies more air than prior-art constructions, while ensuring a satisfactory mixing of air and water.

A device for mixing water and air according to the invention includes a water inlet pipe, one end of which is connected to a water source and the other end of which extends into a water purifier tank, the water inlet pipe defining a mixing portion for mixing air and water. The device also includes an air inlet pipe extending coaxially inside the water pipe to the mixing portion, such that one end of the air pipe is positioned inside the water pipe to form an annular gap between the one end of the air pipe and an inner wall of the water pipe. The device further comprises at least one ring, and preferably three rings, arranged in the mixing portion on the inside of the water pipe, such that, when water is conveyed through the water inlet pipe, the ring (or rings) is hit by the annular water jet formed as the water passes through the annular gap, thereby forcing the water to mix with the air.

The invention will now be described in more detail by means of an embodiment with reference to the accompanying drawing, which schematically shows the inventive device arranged in a water purifier tank.

BRIEF DESCRIPTION OF THE DRAWING

The FIGURE is a cross-sectional view of one embodiment of the invention.

DETAILED DESCRIPTION OF THE INVENTION

The FIGURE shows a mixing device 1 according to the invention mounted in a water purifier tank 2. It should be pointed out that all the components in the water purifier that are not necessary for the understanding of the invention have been excluded from the FIGURE. Such components can be, for instance, pumps, level indicators, gas exhausters. The mixing device has a water inlet pipe 3 extending through the top of the tank. The water pipe end 4 positioned outside the tank is connected to a conduit from a well pump. The water pipe end 5 arranged in the tank is positioned on a level in the lower part of the tank, said level always being positioned below the water surface in the tank. As a result, the water will be continuously stirred in the tank when an air-water mixture flows out in the tank. An air inlet pipe 6 is coaxially mounted in the upper part of the water inlet pipe and has an end located outside the tank. The other end of the air inlet pipe is terminated with a conical expansion 7. Between the inner surface of the water inlet pipe 1 and the expansion 7 there is formed an annular gap 8. After the annular gap, the water inlet pipe is widened and forms a first mixing section 9, in which three rings 10–12 are attached by welding. As the water passes the annular gap 8, air is sucked in through the pipe 6 and a certain mixing takes place in the area of the conical mouth 7 of the pipe 6. The higher the speed of the air, the less mixing in the area of the mouth. The annular water jet that flows downwards from the gap 8 hits the first ring 10, and air and water is mixed adjacent to this ring. This also takes place adjacent to the other two rings 11 and 12 downstream of the first ring. The first mixing section passes into a second mixing section 13 of an increased diameter. The second mixing section 13 is at the mouth 5 of the pipe 3 terminated with a disc 14. The disc has in its periphery three rods 15–17, by means of which the disc is attached at a distance from the mouth of the pipe. The water-air mixture, which contains a large amount of small air bubbles, flows out between the rods and accomplishes a continuous stirring of the water in the tank 2.

In the prior-art constructions, released gases from the water, for instance, radon gas, have been sucked out of the tank by means of a fan. Using the inventive construction, there is no need of a fan. The pressure in the tank will be so high during the purifying procedure that the gases can be removed without any fan via an outlet (not shown) in the upper part of the tank.

It has been found that an increase of the dimension of the pipe between the first and the second mixing section results in improved air suction and, thus, a possibility of obtaining a larger amount of air mixed with the water.

In the preferred embodiment described above, the following measures and dimensions have been used. The uppermost portion of the mixing device 1 is about 150 mm long. The water inlet pipe has an outer diameter of 32 mm, and the air inlet pipe has an outer diameter of 21 mm. The first mixing section 9 is 350 mm long and has an outer diameter of 42 mm. The three rings 10–12 are arranged 60 mm, 160 mm, and 280 mm, respectively, from the beginning of the mixing section 9. The second mixing section 13 is 500 mm long and has an outer diameter of 60 mm. The disc 14 is mounted 50 mm outside the mouth 5 of the pipe. The gap 8 is 1.5 mm wide.

I claim:

1. A device for mixing air and water in a water purifier, comprising:

a water inlet pipe for connecting to a water source and extending into a water purifier tank, the water inlet pipe defining a mixing portion for mixing air and water, an air inlet pipe extending coaxially inside the water pipe to the mixing portion; one end of the air pipe being positioned inside the water pipe to form an annular gap between the one end of the air pipe and an inner wall of the water pipe so that, when water passes through the annular gap, an annular water jet is formed and air is sucked in through the air inlet pipe, and at least one ring arranged on the inside of the water pipe in the mixing portion, such that, when water is conveyed trough the water inlet pipe at one of a plurality of different flow rates, the at least one ring is hit by the annular water jet so as to break up the annular water jet and thereby mix the water with the air.

2. The device as claimed in claim 1, wherein three rings are equidistantly spaced from each other along the vertical direction in the mixing portion.

3. The device as claimed in claim 1, wherein the mixing portion is divided into a first section which accommodates the at least one ring, and a second section having a greater diameter than the first section.

4. The device as claimed in claim 1, further including a disc which is mounted at a distance outside and straight in front of an exit mouth of the water pipe for distributing water flowing out from the mixing device into a water tank.

5. The device as claimed in claim 2, wherein the mixing portion is divided into a first section which accommodates the three rings, and a second section having a greater diameter than the first section.

6. The device as claimed in claim 2, further including a disc which is mounted at a distance outside and straight in front of an exit mouth of the water pipe for distributing water flowing out from the mixing device into a water tank.

7. The device as claimed in claim 3, further including a disc which is mounted at a distance outside and straight in front of an exit mouth of the water pipe for distributing water flowing out from the mixing device into a water tank.

* * * * *